United States Patent [19]

Kuenn et al.

[11] Patent Number: 4,619,710

[45] Date of Patent: Oct. 28, 1986

[54] DISPOSER CLEANER

[75] Inventors: Cary K. Kuenn, Milwaukee; Jean M. Young; John A. Wundrock, both of West Bend, all of Wis.

[73] Assignee: Badger Pharmacal, Inc., Jackson, Wis.

[21] Appl. No.: 804,243

[22] Filed: Dec. 3, 1985

Related U.S. Application Data

[63] Continuation of Ser. No. 602,544, Apr. 20, 1984, abandoned.

[51] Int. Cl.[4] ..... B08B 3/08; B08B 3/10; B08B 7/00; C11D 17/00

[52] U.S. Cl. ..... 134/22.17; 134/22.1; 134/22.19; 134/23; 134/32; 134/33; 134/42; 252/90; 252/93; 252/95; 252/100; 252/103; 252/142; 252/156; 252/174.14; 252/350; 252/533; 252/552

[58] Field of Search ..... 134/22.1, 22.17, 22.19, 134/23, 32, 33; 252/90, 93, 95, 100, 103, 142, 174.14, 350, 533, 552

[56] References Cited

U.S. PATENT DOCUMENTS

| | | | |
|---|---|---|---|
| 3,322,674 | 6/1964 | Friedman | 252/90 |
| 3,506,582 | 4/1970 | Gertzman | 252/157 |
| 3,775,334 | 11/1973 | Christie | 252/171 |
| 3,936,385 | 2/1976 | Cheng | 252/99 |
| 3,997,459 | 12/1976 | Bogie | 252/99 |
| 4,129,526 | 12/1978 | Ogoshi | 252/536 |
| 4,155,868 | 5/1979 | Kaplan | 252/95 |
| 4,181,621 | 1/1980 | Raaf | 252/102 |
| 4,210,550 | 7/1980 | Cornelissens | 252/90 |
| 4,234,442 | 11/1980 | Cornelissens | 252/90 |
| 4,388,204 | 6/1983 | Dimond | 252/98 |

*Primary Examiner*—Dennis L. Albrecht

*Attorney, Agent, or Firm*—Andrus, Sceales, Starke & Sawall

[57] ABSTRACT

A composition for cleaning an in-sink garbage disposer unit containing a surfactant, an alkali carbonate and an acid. Each constituent is present in the composition in the range of 5 to 75% by weight. It is preferred that the composition contain 37.5% adipic acid, 37.5% sodium bicarbonate and 25% of a mixture of sodium lauryl sulfate and alpha-olefin sulfonate. Other ingredients may be added to the surfactant-alkali-acid composition to provide desired properties. For example, halogen containing compounds may be employed in the composition to provide germicidal properties, and abrasives may be incorporated for added physical cleaning of the disposer unit.

10 Claims, No Drawings

DISPOSER CLEANER

This application is a continuation of application Ser. No. 602,544 filed Apr. 20, 1984, now abandoned.

BACKGROUND OF THE INVENTION

The present invention relates to cleaning compositions, and more particularly to a composition for cleaning garbage disposer units.

In-sink garbage disposer units are employed in homes, restaurants and the like to dispose of unwanted food scraps. As a result, garbage disposer units create sanitary problems such as grease build-up, potential for irritable smells and possible harmful bacterial build-up.

By design, any materials fed into a disposer unit are pushed by centrifugal force into a series of cutting blades and forced through a screen into a drain line. Thus, in order to make an effective cleaning/degreasing product for disposer units, it is necessary to provide a product which maintains contact time with the walls of the chamber for grease cutting purposes, and one which is not easily sucked or drawn into the drain during operation of the disposer unit.

Numerous types of cleaning compositions are known in the art. Exemplary of such cleaning compositions are those found in the following patents:

| | |
|---|---|
| Bacon | 4,391,724 |
| Dimond et al | 4,388,204 |
| Gotta et al | 4,384,900 |
| Rapisarda et al | 4,379,069 |
| Falivene | 4,289,640 |
| Cornelisseus | 4,234,442 |
| Corneliusseus | 4,210,550 |
| Ogoshi et al | 4,129,526 |
| Trink et al | 4,051,055 |
| Chang | 4,048,121 |
| Heckert et al | 4,005,030 |
| Savino | 3,928,065 |

The patents to Cornelisseus, Ogoshi et al, Rapisarda et al and Bacon all relate to laundry and/or dishwashing detergent compositions. The patents to Savino, Trink et al, Falivene, Heckert et al, Chang and Gotta et al relate to compositions intended for cleaning hard surfaces such as metal and porcelain while the Dimond et al patent relates to a clogged drain opening composition. None of these patents, however, are directed specifically to a composition for cleaning and sanitizing garbage disposer units.

SUMMARY OF THE INVENTION

A composition for cleaning garbage disposer units contains an alkali carbonate, an acid, and one or more surfactants. The composition contains 5 to 75% by weight of each constituent. It is preferred that the composition contain 37.5% by weight adipic acid, 37.5% sodium bicarbonate and 25% of a mixture of sodium lauryl sulfate and alpha-olefin sulfonate.

When adipic acid and sodium bicarbonate come into contact with hot water in the disposer unit carbon dioxide gas is released. The carbon dioxide acts with the surfactants and the grinding action of the disposer to build a heavy foam and expand to fill the interior chamber of the unit. The foam created by the acid/base reaction temporarily plugs the drain of the disposer which thus allows additional foam to build up in the disposer chamber and rise to emerge through the baffle into the sink. This acid/base reaction provides a mechanism for maintaining foam in the chamber to provide sufficient contact time with the walls of the chamber to effectively clean and degrease the disposer.

Various other constituents in addition to adipic acid, sodium bicarbonate, and surfactants may be blended into the composition to provide numerous desirable properties. For example, alkaline builders such as sodium metasilicate may be employed to impart increased detergent properties to the composition. Other ingredients such as halogen containing compounds weakly soluble in water at room temperatures, but its solubility greatly increases as the water temperature increases beyond 90° F. For example, 100 milliliters of a saturated aqueous solution contains 1.44 g. of adipic acid. However, 100 milliliters of boiling water dissolves 160 g. of adipic acid. The solubility of adipic acid at higher water temperatures greatly enhances its effectiveness in the acid/base reaction necessary for maintaining the foam wall to provide a cleansing action in accordance with the present invention.

The alkali carbonate constituent is present in the range of from about 5 to about 75% by weight, and preferably between 25 and 40% by weight in the present composition. Suitable alkali carbonates include sodium bicarbonate, sodium carbonate, calcined sodium carbonate, sodium sesquicarbonate, potassium bicarbonate, and potassium carbonate. One or more of the above alkali carbonates may be used in the present composition with sodium bicarbonate preferred in an amount of about 37.5% by weight. Sodium bicarbonate is relatively insensitive to moisture and therefore provides adequate shelf life.

Alkaline builders may also be used as a component of the alkali carbonate constituent for the composition of the present invention. Suitable alkaline builders include sodium silicate, sodium disilicate, sodium tripolyphosphate, tetrasodium pyrophosphate, disodium hydrogen orthophosphate, trisodium orthophosphate, sodium metaborate, sodium tetraborate sodium metasilicate, tetrapotassium pyrophosphate, tripotassium orthophosphate, sodium metasilicate and potassium metasilicate. The above alkaline builders impart effective detergent properties to the composition of the present invention. Sodium metasilicate and trisodium phosphate are the preferred may be employed to provide better germicidal properties. Abrasives may be incorporated for added physical cleaning, and colors and/or fragrances may also be added.

The present invention thus provides a composition for cleaning, degreasing and sanitizing a garbage disposer unit.

DESCRIPTION OF THE PREFERRED EMBODIMENT

A composition for cleaning, degreasing and sanitizing a garbage disposer unit. The composition contains an acid, an alkali carbonate and one or more surfactants. The acid and alkali carbonate react in an acid/base reaction with water in the disposer unit to release carbon dioxide gas. This carbon dioxide gas acts with the surfactants and the grinding action of the disposer to build a heavy foam and expand to fill the interior chamber of the unit and emerge through the baffle into the sink.

The acidic constituent is present in the range of 5 to 75% by weight and preferably between 25 and 40% by weight. Suitable acids for use in the composition of the present invention include oxalic, malonic, succinic, glutaric, adipic, pimelic, suberic, azelaic, sebacic, maleic, fumaric, citric, sodium citrate, sodium sulfite, potassium citrate, sodium acid pyrophosphate, sodium dihydrogen orthophosphate, and sodium bisulfate. The preferred acid is adipic acid which is present in an amount of about 37.5% by weight based on the total cleaning composition. Thus, the acidic constituent of the present composition contains one or more acids having the formula:

$HOOC—(CH_2)_n—COOH$, where n is 2, 3, or 4. Adipic acid has the general formula: $C_6H_{10}O_4$ and is prepared by oxidizing cyclohexanol with concentrated nitric acid. Adipic acid is preferred since it is only alkaline builders. These builders add penetrating power to the cleaner and aid in the emulsification of fats, oils, and greases often found in the waste disposer chamber. These builders suspend the fats, oils and greases as fine particles which are then easily washed away. Sodium metasilicate also aids in corrosion inhibition of the sensitive metals and inner parts of the disposer unit.

Surfactants that may be employed are anionics, amphoterics and nonionics either alone or in various combinations. The surfactant constituent is present in the range of from about 5 to about 75% by weight in the composition of the present invention, and is preferably present in the range of 20 to 50% by weight. Suitable alkyl ether sulfates that may be employed are sodium coconut alkyl sulfate, potassium coconut alkyl sulfate, potassium lauryl sulfate, sodium lauryl sulfate, sodium yellow fatty alcohol ether sulfates, tallow fatty alcohol (25 ethylene oxide), tallow fatty ether sulfate, sodium dodecyl benzene sulfonate, sodium stearyl sulfate, sodium palmityl sulfate, sodium decyl sulfate, sodium myristyl sulfate, sodium dodecyl sulfate, potassium dodecyl benzene sulfonates, potassium stearyl sulfate, potassium palmityl sulfate, potassium decyl sulfate, potassium myristyl sulfate, and potassium dodecyl sulfate. Other examples of surfactants that may be used are taurates, sarcosinates, isethionates, alkyl beta-alanines, cycloimides, sulfated ethoxylated fatty alcohols, alpha-olefin sulfonates (AOS), linear alkylbenzene sulfonates (LAS). The preferred surfactant is sodium lauryl sulfate which is available under the trade designation Stepanol WA-100 and Stepanol ME-Dry available from the Stepan Chemical Company, Mayprofix 563 available from the Onyx Chemical Company, Texapon ZHC powder available from Henkel Corp. and Concosulfate WR available from the Continental Chemical Company.

Sodium lauryl sulfate is available in a dry form and has very good detergency, wetting, fast foaming and emulsifying properties. It is particularly effective as a detergent on grease, and has a maximum effect when used in conjunction with inorganic builders such as tetra-sodium pyrophosphate, trisodium phosphate or sodium metasilicate. Because sodium lauryl sulfate is a dry powder, it has a very large surface area and it easily reacted in the acid-base reaction with hot water to form a dense foam. The sodium lauryl sulfate coates the $CO_2$ bubbles created by the acid base reaction and is thus easily carried up the walls of the disposer unit by the action of the acid/base reaction and stays suspended because of its high foam activity. Sodium lauryl sulfate is relatively nontoxic and readily biodegradable. Another preferred surfactant is alpha-olefinsulfonate (AOS) such as that known under the trade designation Bioterge AS-90B available from the Stepan Chemical Company. Alpha-olefinsulfonate is a biodegradable surfactant and is designed to give maximum effectiveness and compatibility with other surfactants in light or heavy duty detergent compositions. Alpha-olefinsulfonate exhibits excellent wetting, foaming, and detersive properties in both alkaline and acid media. It also performs well in the presence of metallic salts commonly found in hard water. The alpha-olefinsulfonate is added to the composition of the present invention to provide increased detergency as a foam booster. The above surfactants may be used alone or in combination.

Phosphate surfactants could also be used in the composition of the present invention, but are not desirable because of their adverse ecological consequences.

The acid/base reaction provides the mechanism for maintaining a foam wall in the chamber of the disposer unit. When adipic acid and sodium bicarbonate, the preferred acid and alkali ingredients, come into contact with water in the disposer unit the following chemical reaction takes place:

| | | | |
|---|---|---|---|
| $HOOC\ (CH_2)_4\ COOH$ + Adipic acid + | | $NaHCO_3$ + Sodium + Bicarbonate | $H_2O$ Water |
| $CO_2$ + Carbon + Dioxide Gas | $H_2O$ + Water + | $NaOOC\ (CH_2)\ COONa$ Sodium salt of Adipic Acid | |

It is the release of the carbon dioxide gas that acts with the surfactants present in the composition and the grinding action of the disposer unit to build a heavy foam and expand to fill the chamber and emerge through the baffle into the sink.

Other ingredients may be added to the composition of the present invention to provide other desirable features. For example, halogen containing compounds, preferably chlorine-containing compounds, may be employed in the surfactant-alkali acid blend to provide better germicidal properties than the blend alone. Suitable halogenated compounds may be found in the following general chemical groups: alkali metal and alkaline earth metal hypochlorites, hypochlorite addition products, chloramines, chlorimines such as Chloramine-T which is p-toluenesulfonchloramide, chloramides, chlorimides, heterocyclic N-Bromo and N-Chloro cyanurates, halogenated hydantoins, halogenated melamines, and inorganic hypohalite releasing agents. Specific examples of some halogenated bactericides that could be used are: monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1, 3-dichloro 5, 5-dimethyl hydantoin, N-chlorosulfamide, Chloramine-T which is p-toluenesulfonchloramide, dichloramine T, chloramine B, dichloramine B, tribromoisocyanuric acid, dibromocyanuric acid, N-monobromo-N-mono-chlorocyanuric acid, N-monobromo-N, N-dichlorocyanuric acid, N-brominated succinamide, malonimide, phthalimide and naphthalimide, N-chlorinated succinimide, malonimide, phthalimide, and naphlhalimide, 1,3-dibromo 5, 5-dimethyl hydantoin, 1,3-dibromo and 1, 3-dichloro-5-isobutyl hydantoin, 1,3-dibromo and 1, 3 dichloro-5-methyl-5-ethyl-hydantoin, tribromomelamine, trichloromelamine, lithium hypochlorite, calcium hypochlorites, and calcium hypobromites. The halogen containing compounds reduce odor causing bacteria and are preferably present in the composition within a range of from about 0.1% to about 1.0% by weight and preferably about 0.4% by weight. Chloramine T which is p-toluenesulfonchloramide, available under the trade designation Chlorazene from Wisconsin Pharmacal Company, and sodium dichloroisocyanurate dihydrate available under the trade designation CDB Clearon from FMC Corporation are the preferred halogen containing germicides.

Other ingredients that may be added to the surfactant-alkali-acid blend includes colors and/or fragrances. Colors that might be used are those food dyes and colorings usually employed in the food and drug industry. Examples of these are F D & C Blue #1, F D & C Yellow #5 and F D & C Red #40. The preferred color is F D & C Blue #1 which is a water soluble blue dye that provides an attractive clear blue color to the foam produced by the present invention. The coloring is generally present in an amount of about 0.05% by weight.

Fragrances that may be used are any suitable acid/-base stabilized fragrance associated with the desirable end results. Examples of such fragrances could be lemon, citrus or pine. Wet lemon fragrance is preferred and is present in the amount of about 1.0% by weight since it is a stable, easily blended fresh scent that leaves the unit and sink with a pleasant smell after treatment with the composition of the present invention.

Abrasive particles in the range of 1–250 micrometers may also be incorporated into the formula for added physical cleaning. Suitable abrasives are: quartz, pumice, pumicite, silica sand, calcium carbonate, calcium phosphate, zirconium silicate, and diatomaceous earth. Diatomaceous earth is preferred. The range of abrasive materials possible are used in percentages from 1.0 to 15.0%. Example VII uses 11.15% of Diatomaceous Earth.

The composition of the present invention is preferably a powder packaged in a moisture resistant foil laminate pouch or packet which would consist of a paper laminated to plastic or synthetic materials. Preferably, the dry powder composition would be packaged into a water soluable, biodegradable disposable film which in turn would be wrapped with a foil pouch to prevent moisture damage. The foil pouch would be opened by a consumer and the entire water soluable pouch containing the composition of the present invention would then be dropped into the unit where it would be disintegrated within the garbage disposer.

In use, a consumer would first run hot water from a faucet at approximately 90–140° F., preferrably about 110° F., into a sink and through the food-receiving chamber of a garbage disposer unit for about one minute. Water exiting from a residential kitchen faucet typically flows at a rate of about 0.5 to about 4.0 gal.-min. depending upon altitude and municipal or well water pressure. The hot water from the faucet would then be reduced to just a trickle, i.e. between about 0.05 to about 0.25 gal./min., and allowed to run into the sink, but not directly into the disposer. The packet containing the composition of the present invention would then be pushed through the rubber baffle in the sink or poured through the drain into the disposer chamber. The disposer would then be turned on and allowed to run until the cleaning cycle is completed, i.e. approximately 3 to 5 minutes. The end of the cleaning cycle is signaled by a swoosh or swish of water and all evidence of foaming will be absent. The water and disposer are then turned off.

The invention is further described in the following examples.

EXAMPLE I

| % by wt | grams | |
|---|---|---|
| 41.60% | 25.0 | adipic acid |
| 41.60 | 25.00 | sodium bicarbonate |
| 8.32 | 5.00 | Nacconal 90-F (Stepan Co.) (Sodium Dodecyl benzene sulfonate) |
| 8.32 | 5.00 | Bioterge AS-90 B (Stepan Co.) (Sodium C14–16 olefin sulfonate) |
| 0.08 | 0.05 | Pine Fragrance, I.T. Corp. #464800 |
| 0.08 | 0.05 | MGK Reodorant (McLaughlin, Gormley, King) |
| 100.00 | 60.1 | gm net weight |

EXAMPLE II

| % by wt | grams | |
|---|---|---|
| 28.8 | 14.40 | adipic acid |
| 28.8 | 14.40 | Sodium bicarbonate |
| 28.8 | 14.40 | Sodium lauryl sulfate (Stepanol ME-Dry) |
| 9.71 | 4.855 | Sodium C 14–16 alpha olefin sulfonate (Bioterge AS-90B) |
| 3.81 | 1.905 | Sodium metasilicate |
| .05 | 0.025 | Dry lemon fragrance |
| .03 | 0.015 | F D & C Blue #1 |
| 100.00 | 50.0 | gm net weight |

EXAMPLE III

| % by wt | grams | |
|---|---|---|
| 33.30 | 25.0 | Adipic Acid |
| 33.30 | 25.0 | Sodium Bicarbonate |
| 13.3 | 10.0 | Calcium carbonate |
| 13.3 | 10.0 | sodium lauryl sulfate |
| 6.8 | 5.0 | sodium metasilicate |
| 100.0 | 75.0 | gm net weight |

EXAMPLE IV

| % by wt | grams | |
|---|---|---|
| 29.65 | 11.86 | Adipic Acid |
| 29.65 | 11.86 | Sodium bicarbonate |
| 29.65 | 11.86 | Stepanol ME Dry |
| 10.00 | 4.00 | Bioterge AS-90-B |
| 1.00 | 0.40 | Fragrance I.T. Corp. #469970 |
| 0.05 | 0.02 | F D & C Blue #1 |
| 100.00 | 40.0 | gm net weight |

EXAMPLE V

| % by wt | grams | |
|---|---|---|
| 32.00 | 24.0 | Sodium Bicarbonate |
| 32.00 | 24.0 | adipic acid |
| 6.67 | 5.00 | sodium lauryl sulfate |
| 13.33 | 10.00 | Bioterge AS-90B |
| 13.27 | 9.95 | Abrasive, Diatomaceous earth |
| 1.33 | 1.00 | CDB Clearon (sodium dichloroisocyanurate dihydrate) |
| 0.07 | 0.05 | F D & C Blue #1 |
| 1.33 | 1.00 | Fragrance |
| 100.00 | 75.00 | gm net wt |

EXAMPLE VI

| % by wt | grams | |
|---|---|---|
| 36.50 | 14.6 | sodium bicarbonate |
| 36.50 | 14.6 | adipic acid |
| 15.00 | 6.0 | sodium lauryl sulfate |
| 10.00 | 4.0 | Bioterge AS-90B |
| 0.95 | 0.38 | Fragrance |
| 1.00 | 0.40 | C D B Clearon |
| .05 | 0.02 | F D & C Blue #1 |
| 100.00 | 40.00 | gm net wt |

EXAMPLE VII

| % by wt | grams | |
|---|---|---|
| 26.35 | 11.86 | adipic acid |
| 26.35 | 11.86 | sodium bicarbonate |
| 26.35 | 11.86 | stepanol ME Dry |
| 8.88 | 4.00 | Bioterge AS-90-B |
| 0.88 | 0.40 | Fragrance I.T. Corp H 469970 |
| 0.04 | 0.02 | F D & C Blue #1 |
| 11.15 | 5.02 | Diatomaceous earth |
| 100.00 | 45.00 | gm net wt. |

The following test was conducted to determine the efficiency of the surfactant-acid-alkali blend in cleaning and degreasing a disposer unit. Animal lard was spread on a set area inside the garbage disposer. The lard was colored with food coloring to better observe cleaning action. The area spread with lard was approximately 3 in. by 0.75 in. and was approximately 0.1 to 2.0 millimeters thick. All formulas of Examples I–VI worked well to remove the lard with Examples IV and VI working best.

The present invention thus provides a composition for cleaning, degreasing and sanitizing garbage disposer units. The composition includes one or more surfactants, an alkali carbonate and an acid. Germicidal ingredients, abrasives, fragrances and/or colors may also be added to the blend as desired.

Various modes of carrying out the invention are contemplated as being within the scope of the following claims particularly pointing out and distinctly claiming the subject matter which is regarded as the invention.

We claim:

1. A composition for cleaning a garbage disposer unit, comprising:

about 37.5% by weight sodium bicarbonate;

about 37.5% by weight adipic acid; and about 25% by weight of a mixture of about 5–95% by weight sodium lauryl sulfate and about 95–5% by weight alpha-olefinsulfonate.

2. The composition of claim 1, further including 0.1 to 1.0% by weight of a chlorine containing compound as a bactericidal agent.

3. The composition of claim 2, wherein said bactericidal agent is selected from the group consisting of p-toluenesulfonchloramide and sodium dichloroisocyanurate dihydrate.

4. The composition of claim 1, wherein said mixture comprises about 60% by weight sodium lauryl sulfate and about 40% by weight alpha-olefinsulfonate.

5. A method of cleaning a food-receiving chamber of a garbage disposer unit, comprising the steps of:

passing water at a rate of about 0.5 to about 4.0 gal./min. and at a temperature of between about 90° F. to about 140° F. through said chamber for about one minute;

reducing the flow of water through said chamber to between about 0.05 to about 0.25 gal./min.;

introducing a container containing a cleaning composition comprising 5–75% by weight of an alkali carbonate, 5–75% by weight of an acid and 5–75% by weight of one or more surfactants into said chamber;

actuating said disposer unit for about 3 to about 5 minutes to shred said container and release said composition within said chamber so that said composition reacts with said water to effervesce and coat the surfaces of said chamber; and deactuating said disposer unit after foaming of said composition is completed.

6. A method of cleaning a food-receiving chamber of a garbage disposer unit, comprising the steps of:

introducing water into said chamber including the steps of passing water at a rate of about 0.5 to about 4.0 gal./min. and at a temperature of between about 90° F. to about 140° F. through said chamber for about one minute, and thereafter reducing the flow of water through said chamber to between about 0.05 to about 0.25 gal./min.;

introducing a cleaning composition comprising 5–75% by weight of an alkali carbonate, 5–75% by weight of an acid, and 5–75% by weight of one or more surfactants into said chamber;

actuating said disposer unit for about 3 to 5 minutes so that said composition reacts with said water to effervesce and produce sufficient foam to fill the chamber and coat the wall surfaces of said chamber, said foam temporarily plugging the outlet of the disposer chamber in order to maintain said foam in said chamber to provide sufficient foam contact time with the wall surfaces of the chamber to effectively clean and degrease the chamber; and deactuating said disposer unit after foaming of said composition is completed.

7. The method of claim 6, wherein said cleaning composition is contained in a packet which is introduced along with said composition into said chamber and disintegrates upon actuation of said disposer unit into fragments which aid in scrubbing the wall surfaces of the chamber.

8. A product for cleaning a food-receiving chamber of a garbage disposer unit, comprising:

a cleaning composition including 5–75% by weight of an alkali carbonate, 5–75% by weight of an acid, and 5–75% by weight of one or more surfactants, said cleaning composition comprises about 37.5% by weight sodium bicarbonate, about 37.5% by weight adipic acid, and about 25% by weight of a mixture of about 5–95% by weight sodium aluryl sulfate and about 95–5% by weight alpha-olefinsulfonate; and a packet containing said cleaning composition composed of a biodegradable, disposable material that disintegrates upon actuation of said disposer unit into fragments which aid in scrubbing the wall surfaces of the disposer cleaner.

9. The product of claim 8, wherein said packet is composed of paper.

10. The product of claim 8, wherein said packet is composed of a water soluable film which solubilizes only after a predetermined period of time.

* * * * *

UNITED STATES PATENT AND TRADEMARK OFFICE

CERTIFICATE OF CORRECTION

PATENT NO. : 4,619,710

DATED : October 28, 1986

INVENTOR(S) : Cary K. Kuenn, et al

It is certified that error appears in the above-identified patent and that said Letters Patent is hereby corrected as shown below:

Column 1, line 34, "Corneliusseus" should be --Cornelissens--

Column 1, line 36, "Trink et al" should be --Trinh et al--

Column 1, line 40, "Cornelisseus" should be --Cornelissens--

Column 1, line 42, "Trink et al" should be --Trinh et al--

Column 2, lines 10&11 beginning with "weakly soluble" and continuing on to the words "the preferred" in column 2, line 46, delete from present location and insert the same at column 3, lines 14&15 before "alkaline."

Column 3, line 59, "coates" should be --coats--

Column 4, line 43, delete "chlorimines"

Column 4, line 44, after "p-toluenesulfon chloramide" insert --chlorimines--.

Signed and Sealed this

Seventh Day of April, 1987

*Attest:*

DONALD J. QUIGG

*Attesting Officer*

*Commissioner of Patents and Trademarks*